US011515665B2

(12) United States Patent
Bobelis et al.

(10) Patent No.: US 11,515,665 B2
(45) Date of Patent: Nov. 29, 2022

(54) PIN AND SLEEVE DEVICE WITH FEATURES TO FACILITATE EASIER ASSEMBLY

(71) Applicant: LEVITON MANUFACTURING CO., INC., Melville, NY (US)

(72) Inventors: Darius Bobelis, Hauppauge, NY (US); Amit Pai, Farmingville, NY (US); Gaurav Surana, Farmingdale, NY (US); Robert Cannetti, Lindenhurst, NY (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 0 days.

(21) Appl. No.: 17/283,313

(22) PCT Filed: Oct. 8, 2018

(86) PCT No.: PCT/US2018/054793
§ 371 (c)(1),
(2) Date: Apr. 7, 2021

(87) PCT Pub. No.: WO2020/076282
PCT Pub. Date: Apr. 16, 2020

(65) Prior Publication Data

US 2021/0408723 A1 Dec. 30, 2021

(51) Int. Cl.
*H01R 13/62* (2006.01)
*H01R 13/622* (2006.01)
(Continued)

(52) U.S. Cl.
CPC ..... *H01R 13/622* (2013.01); *H01R 13/5202* (2013.01); *H01R 13/623* (2013.01); *H01R 13/625* (2013.01); *H01R 13/6278* (2013.01)

(58) Field of Classification Search
CPC ..... H01R 13/622
See application file for complete search history.

(56) References Cited

U.S. PATENT DOCUMENTS 2,874,336 A * 2/1959 Wannemacker ... H01R 13/6278 361/115
2,890,434 A * 6/1959 Anatoly ..... H01R 13/621 439/321
(Continued)

FOREIGN PATENT DOCUMENTS

DE 4437338 A1 1/1996
EP 0683545 A1 11/1995
(Continued)

OTHER PUBLICATIONS

Author Unknown, "50 Amp Wiring Devices"-© Copyright 2008 Leviton Manufacturing Co., Inc.
(Continued)

*Primary Examiner* — Ross N Gushi
(74) *Attorney, Agent, or Firm* — KDB

(57) ABSTRACT

An electrical pin and sleeve device is disclosed. The pin and sleeve device incorporating one or more features to facilitate easier assembly. For example, the pin and sleeve device may include an interrupted thread or a multi-start thread for coupling a first or main housing portion to a second or front housing portion of the device. In this manner, the outer housing can be assembled together with minimal number of turns to facilitate easier and faster assembly. Additionally, and/or alternatively, the front housing portion and the main housing portion may include a key such as, for example, a releasable lock (e.g., a spring plunger assembly) for indexing/indicating the proper rotational position of the front housing relative to the main housing to limit or prevent over-rotation. Additionally, and/or alternatively, a hollow
(Continued)

O-ring may be positioned between the first and second housing portions.

11 Claims, 12 Drawing Sheets

(51) Int. Cl.

| | |
|---|---|
| ***H01R 13/52*** | (2006.01) |
| ***H01R 13/623*** | (2006.01) |
| ***H01R 13/625*** | (2006.01) |
| ***H01R 13/627*** | (2006.01) |

(56) References Cited

U.S. PATENT DOCUMENTS

| | | | | |
|---|---|---|---|---|
| 2,963,536 | A | 12/1960 | Kokalas | |
| 3,020,516 | A | 2/1962 | Despard | |
| 3,120,987 | A | 2/1964 | Degnan | |
| 3,167,374 | A | 1/1965 | Healy | |
| 3,445,805 | A | 5/1969 | McLoad | |
| 3,581,269 | A | 5/1971 | Frey | |
| 3,588,783 | A | 6/1971 | Newman | |
| 3,603,912 | A | 9/1971 | Kelly | |
| 3,611,255 | A | 10/1971 | Shroyer | |
| 3,792,415 | A | 2/1974 | Fuller | |
| 3,796,504 | A | 3/1974 | Marechal | |
| 4,030,741 | A | 6/1977 | Fidrych | |
| 4,063,793 | A | 12/1977 | Judd | |
| 4,114,974 | A | 9/1978 | Lawrence | |
| 4,145,075 | A | 3/1979 | Holzmann | |
| 4,218,110 | A | 8/1980 | Giannaula et al. | |
| 4,250,348 | A | 2/1981 | Kitagawa | |
| 4,421,369 | A | 12/1983 | Myking | |
| 4,580,865 | A | 4/1986 | Fryberger | |
| 5,259,782 | A | 11/1993 | Giffin | |
| 5,410,104 | A | 4/1995 | Gretz et al. | |
| 5,470,248 | A | 11/1995 | Wood | |
| 5,711,066 | A | 1/1998 | Castaldo | |
| 5,743,759 | A | 4/1998 | Pudims et al. | |
| 5,857,873 | A | 1/1999 | Castaldo | |
| 5,863,221 | A | 1/1999 | Castaldo | |
| 5,866,853 | A | 2/1999 | Sheehan | |
| 5,920,035 | A | 7/1999 | Haney et al. | |
| 6,017,243 | A | 1/2000 | Castaldo | |
| 6,331,123 | B1 | 12/2001 | Rodrigues | |
| 6,371,807 | B1 | 4/2002 | Takagishi et al. | |
| 6,605,781 | B2 | 8/2003 | Milanowski et al. | |
| 7,029,328 | B1 | 4/2006 | Mckenzie et al. | |
| 7,285,014 | B2 | 10/2007 | Castaldo et al. | |
| 7,758,367 | B2 * | 7/2010 | Siebens | H01R 13/631 439/271 |
| 7,857,647 | B2 | 12/2010 | Bracci et al. | |
| 7,874,860 | B2 * | 1/2011 | Starke | H01R 13/622 439/216 |
| 8,288,667 | B2 | 10/2012 | Chiou | |
| 10,256,566 | B2 | 4/2019 | Eun | |
| 10,404,050 | B2 | 9/2019 | Hutsler | |
| 2006/0033218 | A1 | 2/2006 | Hafner et al. | |
| 2006/0141844 | A1 | 6/2006 | Tufano, Jr. | |
| 2006/0154502 | A1 | 7/2006 | Castaldo | |
| 2007/0037429 | A1 | 2/2007 | Scholler et al. | |
| 2009/0060420 | A1 | 3/2009 | Cull et al. | |
| 2012/0034809 | A1 | 2/2012 | Reimchen | |
| 2012/0135629 | A1 | 5/2012 | Montena | |
| 2012/0329311 | A1 | 12/2012 | Duval et al. | |
| 2021/0167545 | A1 | 6/2021 | Bobelis et al. | |

FOREIGN PATENT DOCUMENTS

| | | | |
|---|---|---|---|
| GB | 490013 | A | 8/1938 |
| GB | 2204750 | A | 11/1988 |

OTHER PUBLICATIONS

Author Unknown, "Black & White—50A Locking Plugs and Connectors-3 Wire and 4 Wire" Installation Instructions © 2019 Leviton Mtg. Co., Inc.

International Search Report and Written Opinion for corresponding PCT Application PCT/US2018/054793, dated Dec. 7, 2018.

Author unknown, "Pin & Sleeve" 2016 Leviton Manufacturing Co., Inc.

International Search Report and Written Opinion for the International Patent Application No. PCT/US2019/042742, dated Oct. 10, 2019, 14 pages.

International Preliminary Report on Patentability for the International Patent Application No. PCT/US2019/042742, dated Mar. 11, 2021, 9 pages.

* cited by examiner

PIN AND SLEEVE DEVICE WITH FEATURES TO FACILITATE EASIER ASSEMBLY

This application is a United States National Phase filing of International Application No. PCT/US2018/054793, filed Oct. 8, 2018, which application is incorporated herein by reference in its entirety.

FIELD OF THE DISCLOSURE

The present disclosure relates generally to electrical devices such as pin devices and corresponding sleeve devices, and more particularly to pin devices and sleeve devices incorporating one or more features to facilitate easier assembly.

BACKGROUND OF THE DISCLOSURE

Pin and sleeve devices including plugs, connectors, receptacles, inlets, mechanical interlocks, etc. are well known in the art. As used herein, pin devices and sleeve devices will be collectively referred to as pin and sleeve devices. Herein, a single device having either pins (e.g. a plug), sleeves (e.g. a connector), or both pins and sleeves will be referred to as a pin and sleeve device. However, reference to a pin and sleeve device is not intended to mean that any such device has to include both pins and sleeves. Such a device can include one or more pins, one or more sleeves, or both pins and sleeves.

Generally speaking, pin and sleeve devices are often used to supply electrical power in harsh or high abuse environments such as, for example, wet or corrosive environments. Pin and sleeve devices are well-suited to supply electrical power to heavy equipment such as, for example, welders, motors, compressors, conveyors, portable tools, portable lighting, etc. In use, pin and sleeve devices may provide electrical connections safe from dust and water. As such, pin and sleeve devices are designed to provide power connections that are safe and secure from the environment (e.g., moisture, dirt, grime, chemicals, etc.), prevent accidental disconnect under load, and ensure high strength durability. Pin and sleeve devices provide standardized connectors and may be rated at any suitable current and voltage levels. For example, pin and sleeve devices may be rated at current levels of 16 A, 20 A, 30 A, 32 A, 60 A, 100 A, 150 A, 200 A, 400 A, or the like. In addition, pin and sleeve devices may be rated at voltage levels of 125V, 240V, 250V, 480V, 600V, 100/130V, 125/250V, 102/208V, 200/250V, 208/250V, 277/480V, 346-415V, 347/600V, 380/415V, 440-460V, and others. Moreover, pin and sleeve devices may be rated for any suitable electrical phase configuration such as single-phase, three-phase delta, and three-phase wye.

It would be desirable to provide pin and sleeve devices with one or more features to facilitate easier assembly and use.

SUMMARY OF THE DISCLOSURE

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an electrical pin and sleeve device including an outer housing including a first housing portion and a second housing portion, a contact carrier at least partially positioned within the outer housing, the contact carrier including a plurality of holes, a body member at least partially positioned within the outer housing and coupled to the contact carrier, and a plurality of electrical contacts, each of the plurality of contacts being positioned at least partially within a respective one of the plurality of holes in the contact carrier, wherein the first and the second housing portions each include a coupling end having an interrupted thread formed thereon, each interrupted thread including a threaded segment and a threadless section.

In one embodiment, the interrupted thread formed on the coupling end of the first housing portion includes a plurality of threaded segments circumferentially spaced about a circumference thereof, the plurality of threaded segments being circumferentially spaced apart by the threadless sections formed on the coupling end of the first housing portion. The interrupted thread formed on the coupling end of the second housing portion includes a plurality of threaded segments circumferentially spaced about a circumference thereof, the plurality of threaded segments being circumferentially spaced apart by the threadless sections formed on the coupling end of the second housing portion. The threaded segments formed on the coupling end of the first housing portion being arranged and configured to be axially received within the threadless sections formed on the coupling end of the second housing portion. The threaded segments formed on the coupling end of the second housing portion being arranged and configured to be axially received within the threadless sections formed on coupling end of the first housing portion. In use, the second housing portion is coupled to the first housing portion via partial rotation of the second housing portion relative to the first housing portion after axially inserting the coupling end of the second housing portion and the coupling end of the first housing portion, one within the other.

In another embodiment, an electrical pin and sleeve device includes an outer housing including a first housing portion and a second housing portion, a contact carrier at least partially positioned within the outer housing, the contact carrier including a plurality of holes, a body member at least partially positioned within the outer housing and coupled to the contact carrier, and a plurality of electrical contacts, each of the plurality of contacts being positioned within a respective one of the plurality of holes in the contact carrier, wherein the first and the second housing portions each include a key arranged and configured to secure a final position of the second housing portion relative to the first housing portion when the second housing portion is coupled to the first housing portion.

In one embodiment, the key is a releasable lock arranged and configured to selectively lock and release the second housing portion relative to the first housing portion.

In one embodiment, the key is a spring plunger assembly arranged and configured to selectively lock and release the second housing portion relative to the first housing portion. One of the first and second housing portions include the spring plunger assembly and the other one of the first and second housing portions include a recess arranged and configured to receive a portion of the spring plunger assembly.

In various embodiment, the pin and sleeve device may include a hollow O-ring, the hollow O-ring being positioned between the first and second housing portions.

BRIEF DESCRIPTION OF THE DRAWINGS

By way of example, a specific embodiment of the disclosed device will now be described, with reference to the accompanying drawings, in which.

Figure 1:
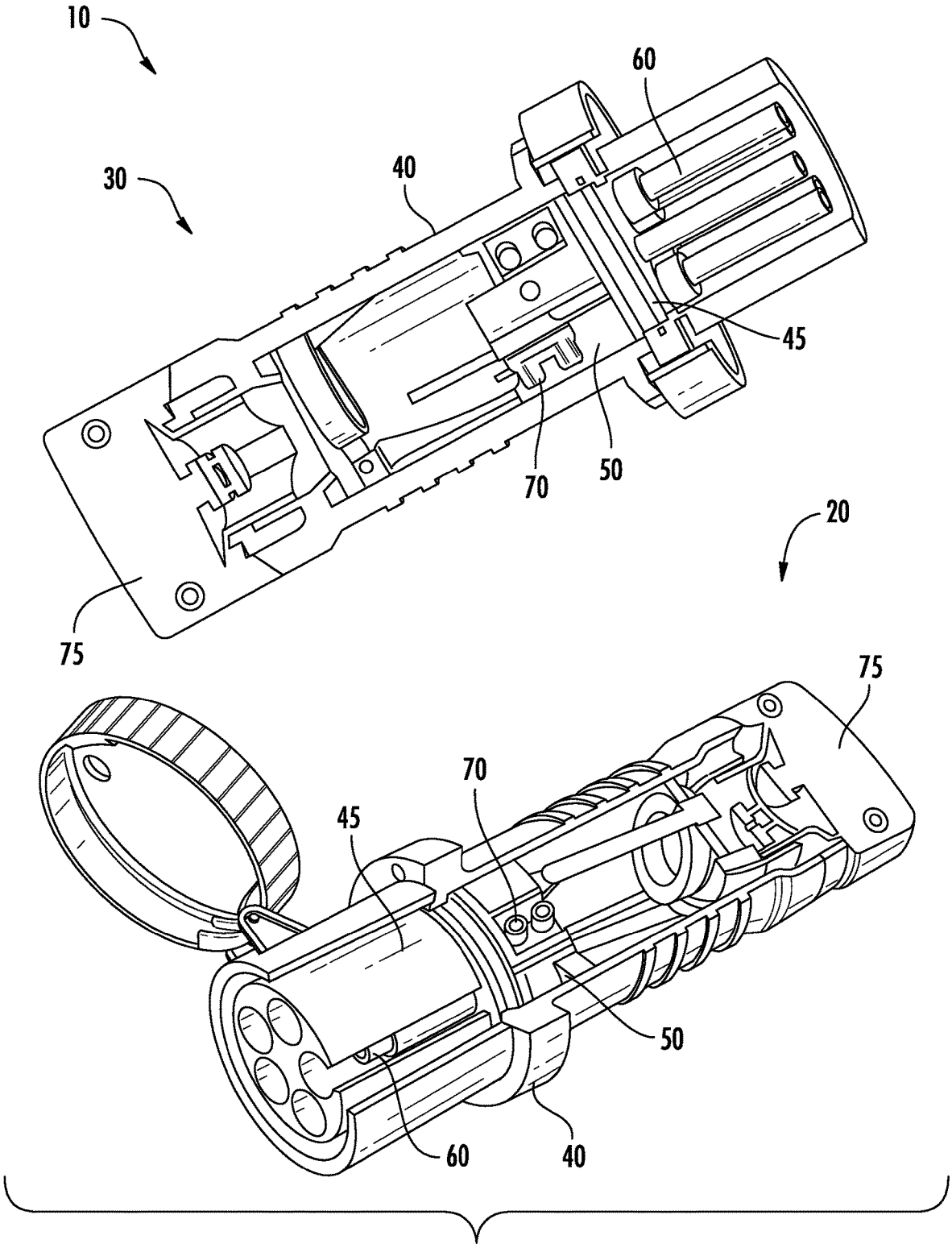
FIG. 1 (PRIOR ART)
FIG. 1 shows cut-away views of known pin and sleeve devices (e.g., a plug and a connector, respectively)

The drawings are not necessarily to scale. The drawings are merely representations, not intended to portray specific parameters of the disclosure. The drawings are intended to depict example embodiments of the disclosure, and therefore are not be considered as limiting in scope. In the drawings, like numbering represents like elements.

DETAILED DESCRIPTION

Numerous embodiments of improved pin and sleeve devices in accordance with the present disclosure will now be described more fully hereinafter with reference to the accompanying drawings, in which preferred embodiments of the present disclosure are presented. As will be described and illustrated, in some embodiments, the electrical pin and sleeve device incorporates one or more features to facilitate easier assembly. The pin and sleeve device of the present disclosure may, however, be embodied in many different forms and should not be construed as being limited to the embodiments set forth herein. Rather, these embodiments are provided so that this disclosure will convey certain example aspects of the pin and sleeve device to those skilled in the art. In the drawings, like numbers refer to like elements throughout unless otherwise noted.

As will be described in greater detail below, in various embodiments, a pin and sleeve device according to the present disclosure may include one or more features to facilitate easier assembly. That is, for example, according to the present disclosure, an electrical pin and sleeve device may include a quick turn assembly for coupling a first portion of a pin and sleeve device such as, for example, a front housing portion of an outer housing to a second portion of the pin and sleeve device such as, for example, a main housing portion of the outer housing. That is, in one embodiment, the front housing portion may be coupled to the main housing portion by way of a discontinuous or interrupted thread (collectively referred to herein as an interrupted thread without the intent to limit) so that the outer housing can be assembled together with minimal number of turns to facilitate easier and faster assembly (e.g., a quarter turn, or less, can securely engage the complementary threads formed on the front housing portion and the main housing portion). Alternatively, the first or front housing portion and the second or main housing portion may be coupled to each other via a multi-start thread to facilitate easier and faster assembly. Additionally, and/or alternatively, the front housing portion and the main housing portion may include a key such as, for example, a releasable lock (e.g., a spring plunger assembly) for indexing/indicating the proper rotational position of the front housing relative to the main housing to limit or prevent over-rotation. Additionally, and/or alternatively, the pin and sleeve device may include a hollow O-ring positioned between the front housing and the main housing.

As will be described herein, the features according to the present disclosure may be used with any suitable electrical pin and sleeve device now known or hereafter developed. As such, details regarding construction and operation of the electrical pin and sleeve devices are omitted for sake of brevity of the present disclosure. In this regard, the present disclosure should not be limited to the details of the electrical pin and sleeve device disclosed and illustrated herein unless specifically claimed and that any suitable electrical pin and sleeve device can be used in connection with the principles of the present disclosure.

Generally speaking, as will be appreciated by one of ordinary skill in the art, pin and sleeve devices are used to supply power to connected devices. As will be appreciated by one of ordinary skill in the art, pin and sleeve devices may encompass plugs, connectors, receptacles, inlets, mechanical interlocks, etc. These devices will be collectively referred to herein as a pin and sleeve device without the intent to limit.

Referring to FIG. 1, in one embodiment, a connector 20 may be connected to power and a plug 30 may be connected to a downstream electrical device, or vice-versa. In use, the plug 30 may be connected to the connector 20 to supply power to a downstream electrical device. As will be readily appreciated by one of ordinary skill in the art, each of the pin and sleeve devices 10 may include an outer housing 40, a contact carrier 45, a body member 50, and electrical contacts 60. The electrical contacts 60 in the connector 20 may generally be in the form of sleeves while the electrical contacts 60 in the plug 30 may generally be in the form of pins for contacting the sleeves in the connector 20. Sleeves and pins are arranged and configured to electrically contact and mechanically engage with each other. Optionally, each of the pin and sleeve devices 10 may also include one or more terminal screws 70 for securing electrical conductors of an electrical cable 15 (FIG. 2) to the contacts 60, a cord clamp 75 for securing the electrical cable 15 to the pin and sleeve device 10, one or more grommets or seals, a cap, etc. Additionally, as will be appreciated by one of ordinary skill in the art, an inlet (not shown) may be used in placed of a plug for coupling to a connector and/or a receptacle may be used in place of a connector for coupling to a plug in a panel or box mount.

Figure 2:
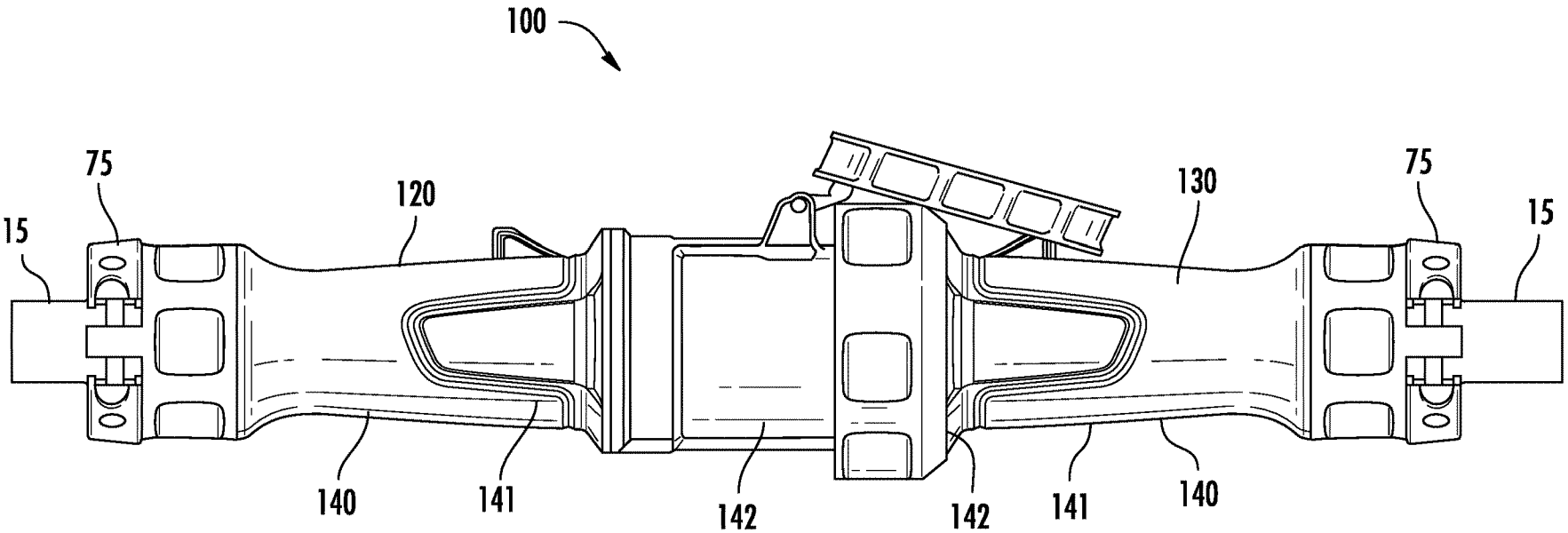
FIG. 2 is a side view of an example embodiment of pin and sleeve devices in accordance with one aspect of the present disclosure, the pin device shown coupled to the sleeve device.
Figure 3A:
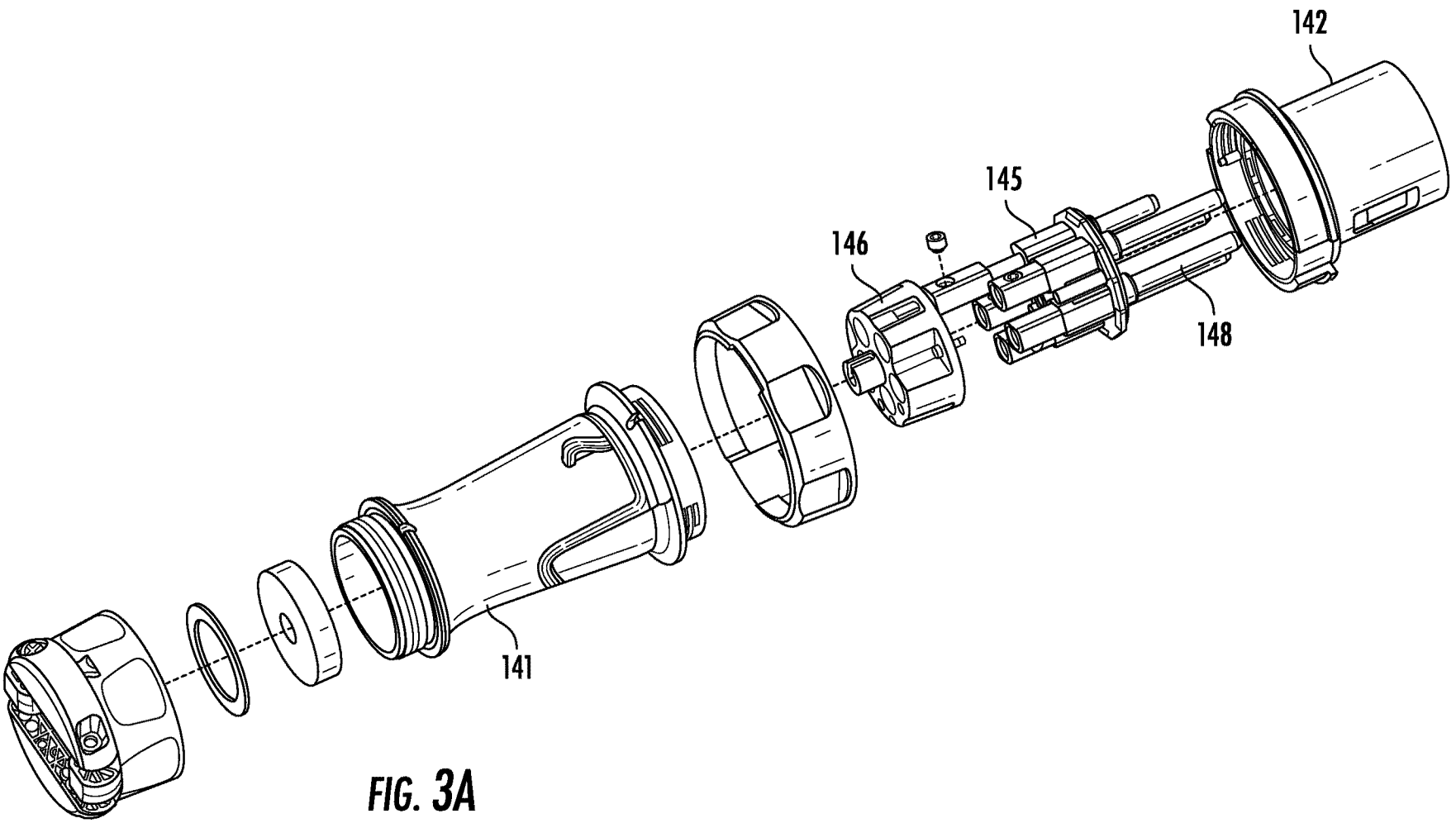
FIGS. 3A and 3B illustrate exploded, perspective views of an example embodiment of pin and sleeve devices in accordance with one aspect of the present disclosure, the pin and sleeve devices illustrated with a first or main housing portion decoupled from a second or front housing portion.
Figure 3B:
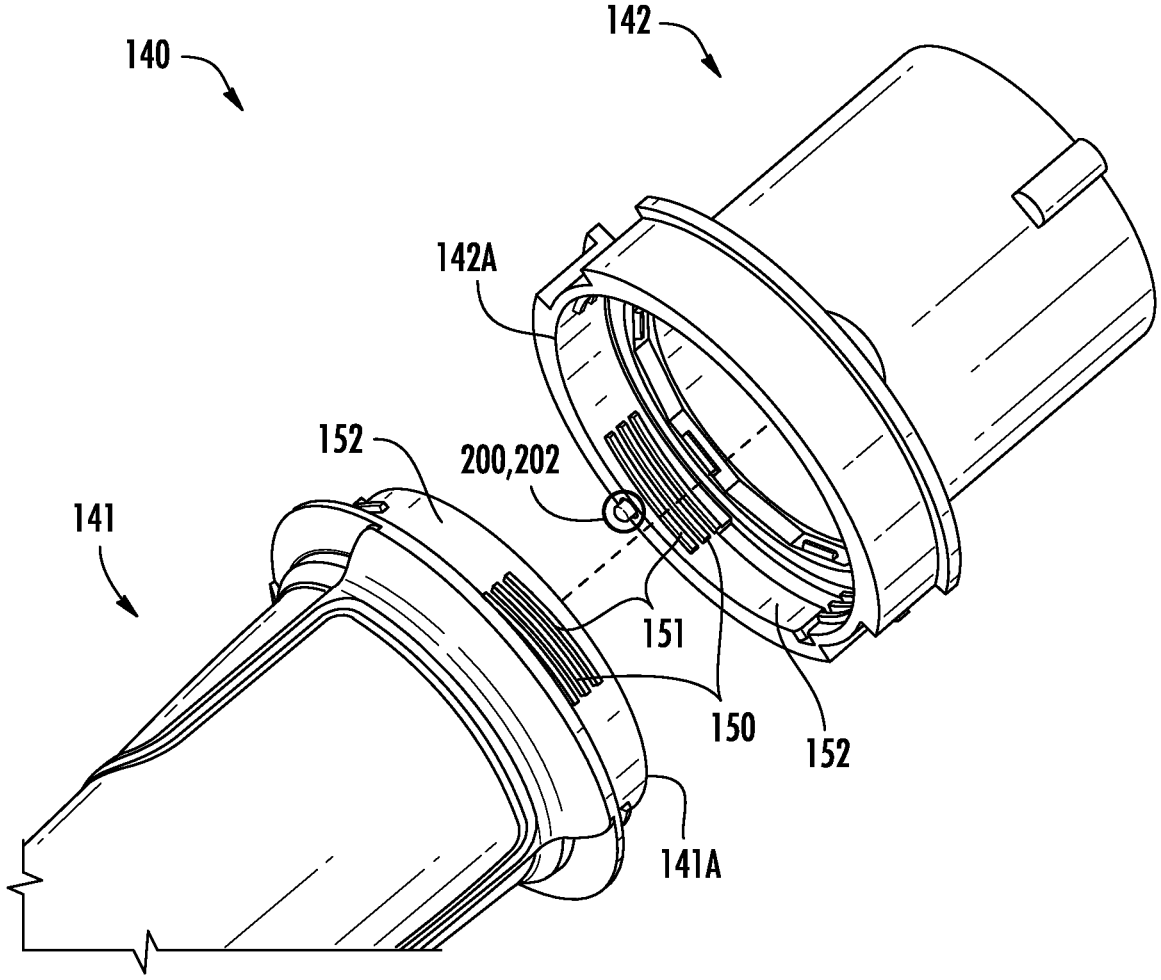

In accordance with one or more various aspects of the present disclosure, referring to FIG. 2, as will be appreciated by one of ordinary skill in the art, a plug 130 may be coupled to a connector 120. As previously mentioned, the connector 120 may be connected to power via electrical conductors of a first electrical cable 15 and the plug 130 may be connected to a downstream electrical device via electrical conductors of a second electrical cable 15. In this manner, power may be supplied to the downstream electrical device.

In use, the connector 120 and the plug 130 may each include an outer housing 140 manufactured from one or more portions. For example, referring to FIGS. 2-5, the outer housing 140 may be manufactured and/or assembled by coupling a first or main housing 141 to a second or front housing 142. As will be appreciated by one of ordinary skill in the art, the first or main housing 141 and the second or front housing 142 may include a contact carrier 145, a body member 146, a plurality of contacts 148, etc. In accordance with one aspect of the present disclosure, the main housing 141 may be coupled/assembled to the front housing 142 via a quick turn action or assembly. That is, the front housing 142 may be coupled to the main housing 141 by an interrupted thread 150 so that once properly positioned, the front housing 142 may be coupled to the main housing 141 by a quarter turn or less (e.g., one-quarter turn rotation, one-eighth turn rotation, or the like turn). In this manner, the outer housing 140 can be assembled together with minimal number of turns (e.g. rotational displacement) to facilitate easier and faster assembly.

Referring to FIGS. 3A-5, in one example embodiment, the main housing 141 (FIGS. 3B and 4) may include a coupling end 141A and the front housing 142 (FIGS. 3B and 5) may include a coupling end 142A. The coupling end 141A of the main housing 141 being arranged and configured to couple with the coupling end 142A of the front housing 142 so that the front housing 142 and the main housing 141 may be coupled to each other. As illustrated, in one example embodiment, the coupling end 141A of the main housing 141 and the coupling end 142A of the front housing 142 may each include an interrupted thread 150. As illustrated, the interrupted thread 150 may be in the form of a helical thread that is periodically discontinuous, or interrupted, around a circumference thereof for a predetermined arc length resulting in threaded segments or sections 151 and threadless channels or sections 152 along a circumferential length of the main and front housings 141, 142.

In one embodiment, the threadless channels or sections 152 formed in the interrupted thread 150 and the threaded segments 151 formed in the interrupted thread 150 are circumferentially aligned with each other so that, for example, the threaded segments 151 on the front housing 142 can be aligned with the threadless sections 152 formed on the main housing 141. Thereafter, the front housing 142 can be coupled to the main housing 141 by axially sliding or inserting the front housing 142 and the main housing 141, one within the other, after which, for example, a quarter turn, or less, of rotation of the front housing 142 relative to the main housing 141 is needed to securely engage the two sets of complementary threads 150.

Figure 4:
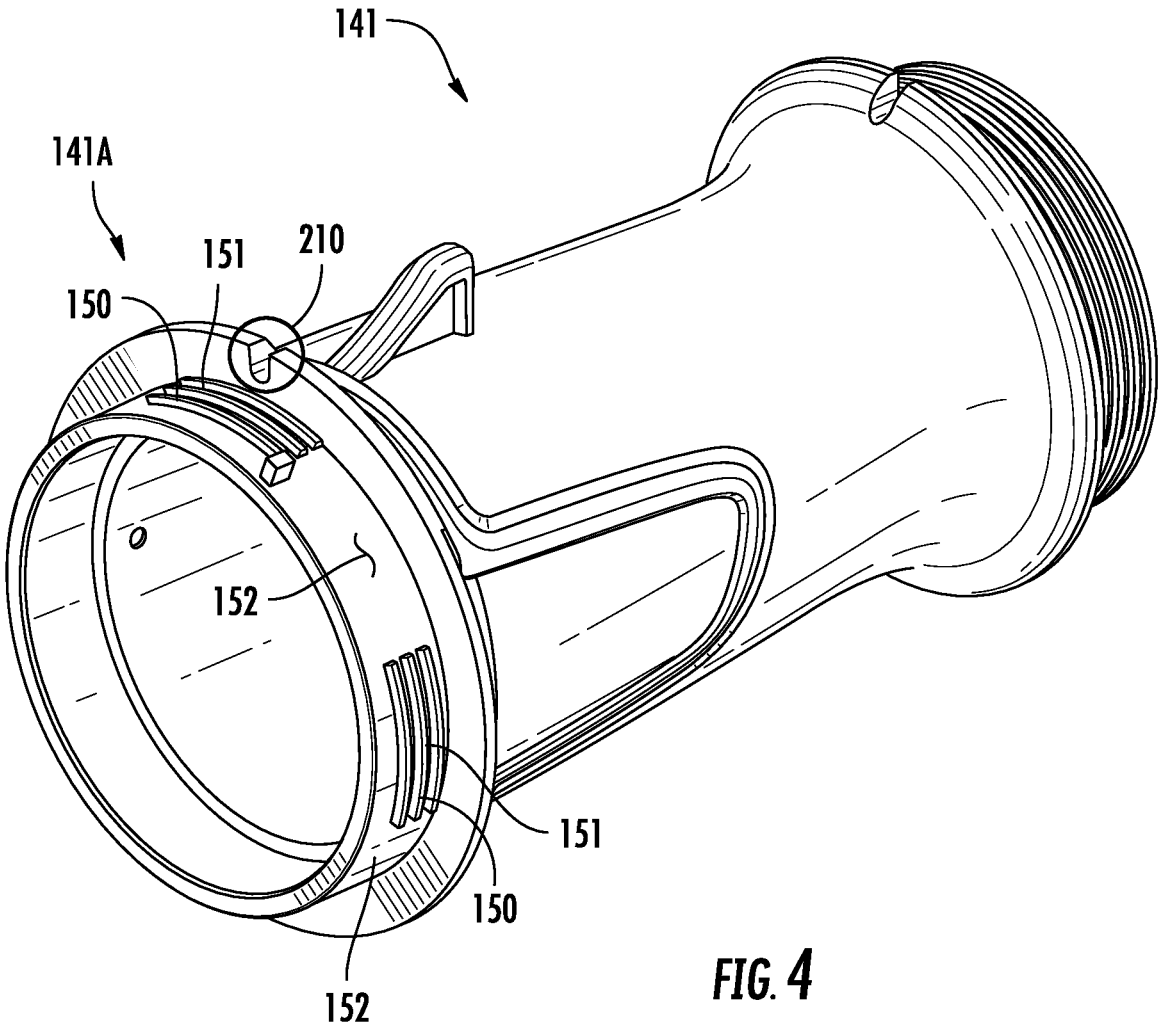
FIG. 4 is a perspective view of an example embodiment of a main housing portion for use with the pin and sleeve device shown in FIG. 2 in accordance with one aspect of the present disclosure.
Figure 5:
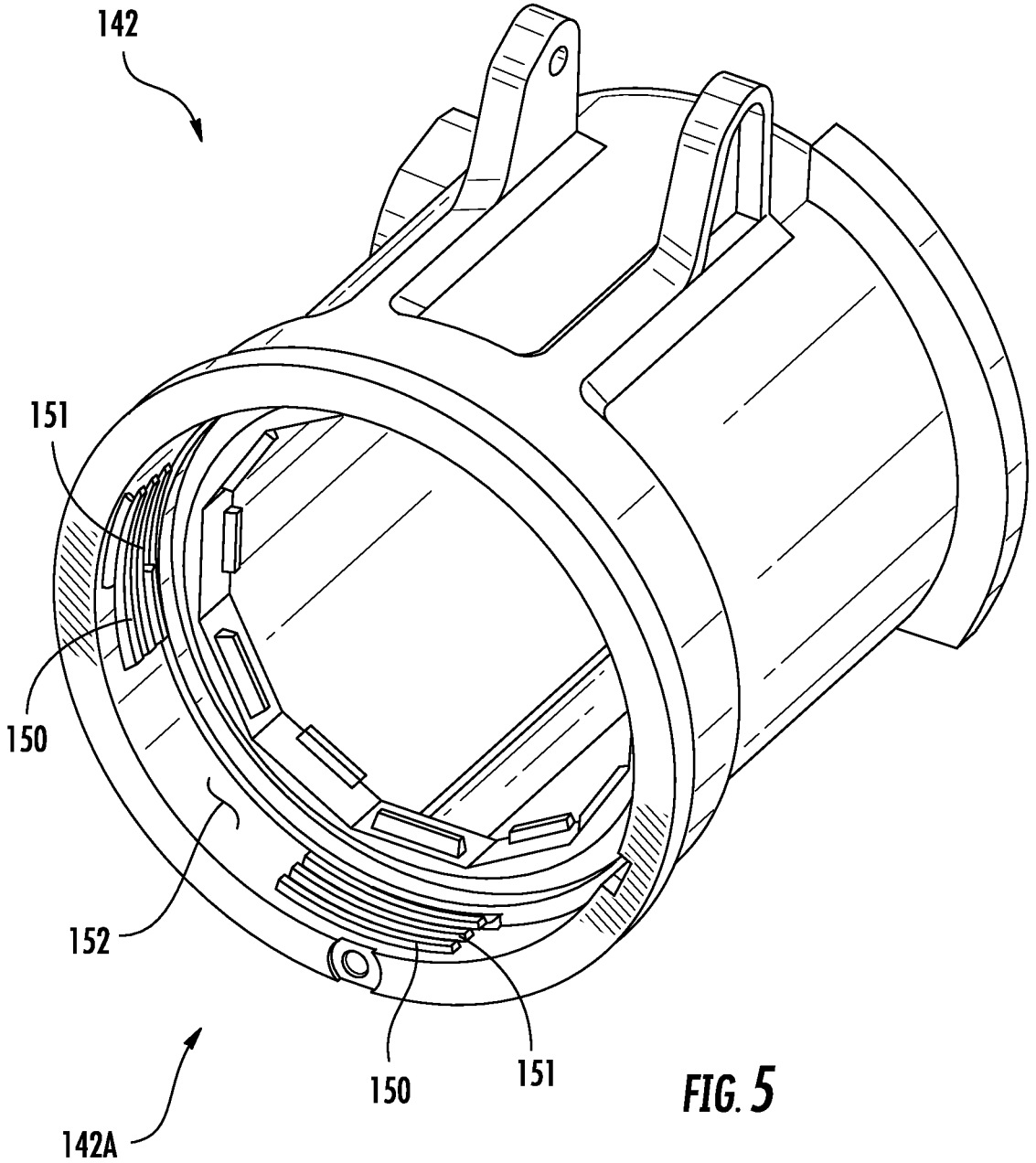
FIG. 5 is a perspective view of an example embodiment of a front housing portion for use with the pin and sleeve device shown in FIG. 2 in accordance with one aspect of the present disclosure.

In this manner, the main housing 141 and the front housing 142 may each include a plurality of threaded segments 151 circumferentially spaced about its circumference. For example, as illustrated in FIG. 4, the main housing 141 may, in one non-limiting example, include four circumferentially spaced threaded segments 151 (e.g., positioned ninety degrees apart) and four circumferentially spaced threadless sections 152 (e.g., positioned ninety degrees apart). Each set of circumferentially spaced threaded segments 151 may, in one non-limiting example, include three threads. Similarly, as illustrated in FIG. 5, the front housing 142 may, in one non-limiting example, include four circumferentially spaced threaded segments 151 (e.g., positioned ninety degrees apart) and four circumferentially spaced threadless sections 152 (e.g., positioned ninety degrees apart). In one example embodiment, each of the threaded segments 151 and each of the threadless sections 152 may have an arc length of approximately 45 degrees minus a small amount of clearance to permit axially insertion of a threaded segment 151 between adjacent threadless sections 152. In this manner, the total arc length of the threaded segments 151 and the threadless sections 152 is 360 degrees. Moreover, in this manner, the total combined arc length of the threaded segments 151 and the total combined arc length of the threadless sections 152 enable a total engagement of approximately 180 degrees (e.g., threaded segments 151 on the main housing 141 engage the threaded segments 152 on the front housing 142 over a total circumference of approximately 180 degrees when coupled together, minus a small amount for clearance).

In use, the threaded segments 151 formed on the front housing 142 may be positioned within the threadless sections 152 formed on the main housing 141, or vice-versa. The threaded segments 151 formed on the front housing 142 may be received within the threadless sections 152 between the threaded segments 151 formed on the main housing 141 with minimum additional clearance. Thereafter, the front housing 142 can be rotated relative to the main housing 141 and, more specifically, the front housing 142 can be rotated approximately 90 degrees (e.g., a quarter diameter) relative to the main housing 141 to fully couple the front housing 142 to the main housing 141.

In this manner, the quick turn action allows for axial pre-positioning of the front housing 142 relative to the main housing 141 by aligning the threaded segments 151 formed on the front housing 142 in the threadless sections 152 formed in the main housing 141, and vice-versa. Thereafter, the connection can be completed by a simple quarter-turn thereby simplify assembly of the outer housing 140 as compared to a continuous threaded connection. Additionally, the quick turn action facilitates creation of axial compression on, for example, a gasket, O-ring, taper, or the like with minimal rotational motion requirements.

Figure 6:
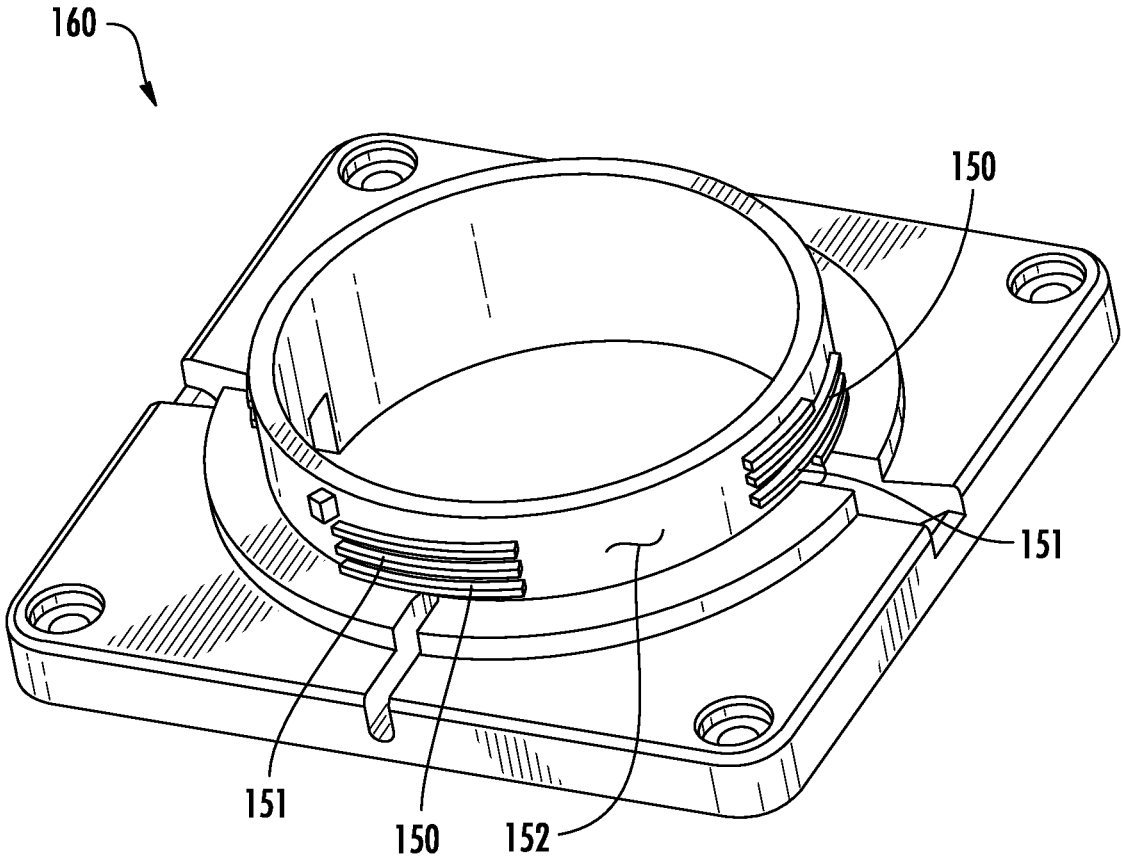
FIG. 6 is a perspective view of an example embodiment of an adapter plate for use with the front housing portion of the pin and sleeve device shown in FIG. 5 in accordance with one aspect of the present disclosure.

It should be appreciated that while the present disclosure is being described and illustrated in connection with coupling the front housing 142 of a pin and sleeve device 100 to the main housing 141, it is envisioned that the quick turn action can be used to couple any cylindrical components or parts thereof. For example, referring to FIG. 6, the quick turn action may be used to mate the pin and sleeve device 100 to an adapter plate 160 used in connection with an inlet or outlet, for coupling the pin and sleeve device 100 to an electrical panel.

Additionally, it should be appreciated that the quick turn action in accordance with the principles of the present disclosure provides the added benefit that the threaded segments 151 formed on the front housing 142 can be coupled with any of the threaded segments 151 formed on the main housing 141. Thus, the quick turn action allows for quick and easy coupling since it isn't required to align a specific thread on the front housing 142 with a specific thread on the main housing 141.

It should be noted that while the main housing 141 and the front housing 142 have been described and illustrated as including four threaded segments 151 circumferentially spaced 90 degrees apart, it is envisioned that different number of threaded segments can be used. For example, three threaded segments can be used that are circumferentially spaced 120 degrees apart, two threaded segments can be used that are circumferentially spaced 180 degrees apart, six threaded segments can be used that are circumferentially spaced 30 degrees apart, and so on. Additionally, while it has been described and illustrated as each threaded segment 151 includes 3 individual threads, it is envisioned that each threaded segment 151 may include more or less individual threads such as, for example, 2, 4, 5, or more.

Figure 7:
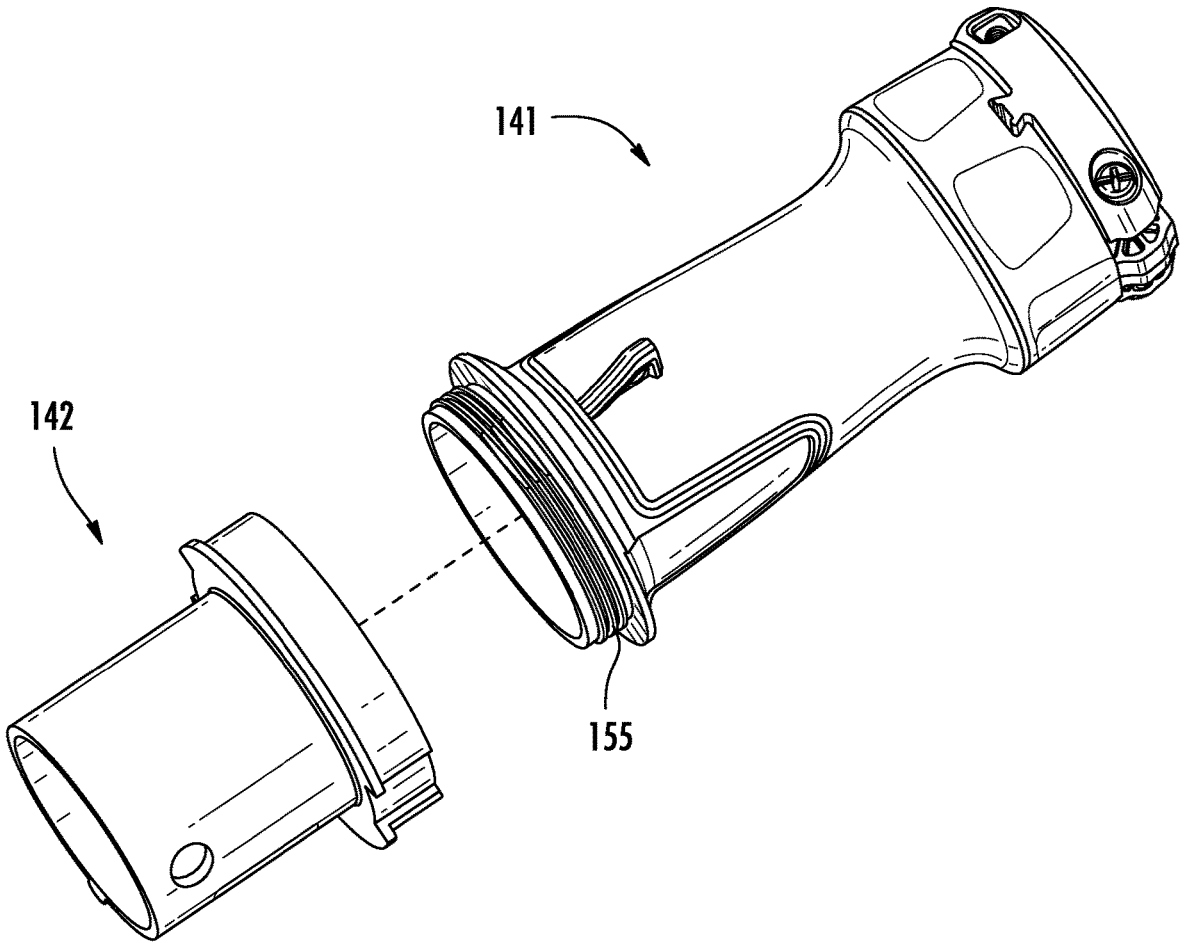
FIG. 7 is an exploded, perspective view of an example embodiment of a pin and sleeve device in accordance with one aspect of the present disclosure, the pin and sleeve device illustrated with a first or main housing portion decoupled from a second or front housing portion.

Alternatively, referring to FIG. 7, in an alternate embodiment in accordance with the present disclosure, the first or main housing portion 141 and the second or front housing 142 may each include a multi-start thread 155. In use, the multi-start thread 155 can include a coarse pitch (e.g., high helix angle). As will be appreciated by one of ordinary skill in the art, the multi-start thread 155 includes two or more parallel, non-crossing helixes. In one preferred embodiment, the multi-start thread 155 includes two to four parallel, non-crossing helixes, and more preferably three parallel, non-crossing helixes.

Figure 8:
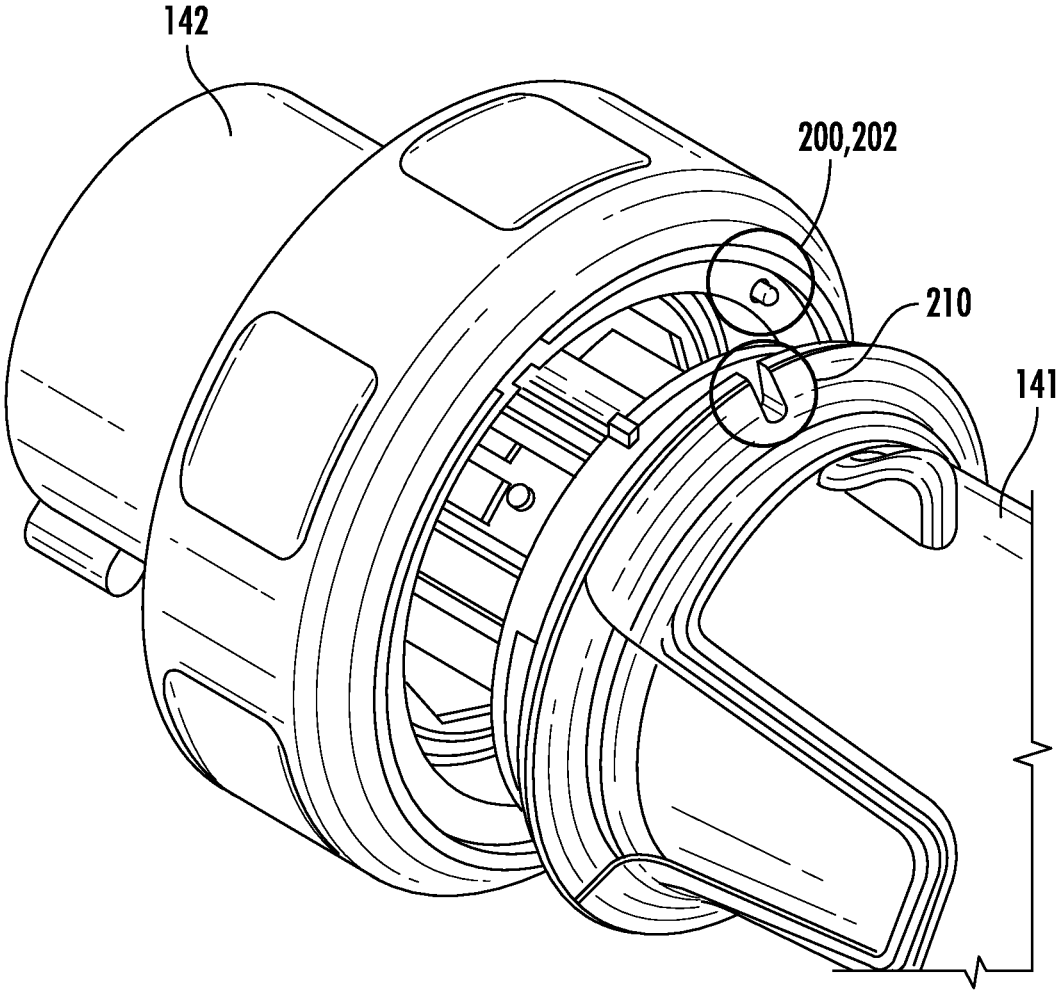
FIG. 8 is an exploded, perspective view of an example embodiment of a main housing portion and a front housing portion for use with the pin and sleeve device shown in FIG. 2 in accordance with one aspect of the present disclosure.
Figure 9:
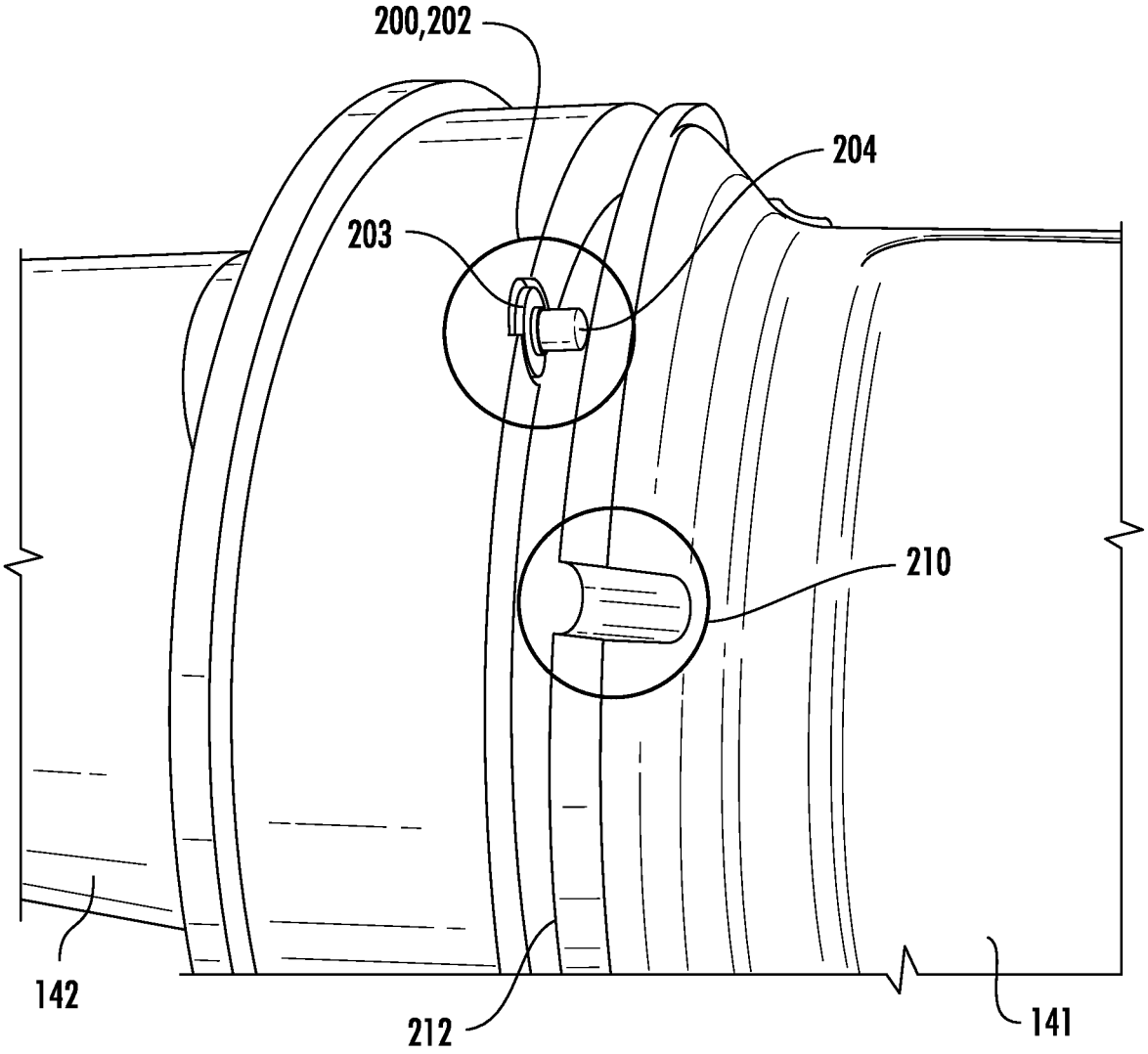
FIG. 9 is an alternate perspective view of an example embodiment of a main housing portion and a front housing portion for use with the pin and sleeve device shown in FIG. 2 in accordance with one aspect of the present disclosure.

Referring to FIGS. 8 and 9, in accordance with another aspect of the present disclosure, the first or main housing 141 and the second or front housing 142 may include a key 200 for securing the position of the front housing 142 relative to the main housing 141 when properly positioned. The key 200 may be any suitable key for indicating and securing the position of the front housing 142 relative to the main housing 141. In one example embodiment, the key 200 may be a releasable lock for selectively locking and releasing the front housing 142 relative to the main housing 141. For example, as illustrated, the releasable lock may be a spring plunger assembly 202 for securing the front housing 142 relative to the main housing 141 once the position of the front housing 142 is properly positioned relative to the main housing 141.

Referring to FIG. 9, in use and as will be appreciated by one of ordinary skill in the art, the spring plunger assembly 202 may include a body 203, a movable plunger pin 204 and a spring (not shown) for biasing the pin 204 away from the front housing 142 and toward the main housing 141. As illustrated, the front housing 142 may include the spring plunger assembly 202 in a face thereof. The main housing 141 may include a recess, hole, receptacle, or like 210 for receiving the pin 204. Thus arranged, during rotation of the front housing 142 relative to the main housing 141, the pin 204 may contact, compress, and slide relative to a facing surface 212 of the main housing 141 until the pin 204 is aligned with the recess 210 where the pin 204, which is outwardly biased, may be extended and received within the recess 210 when the front housing 142 is at a defined position relative to the main housing 141. As such, during assembly of the pin and sleeve device 100, the spring plunger assembly 202 may positively align and secure the position of the front housing 142 relative to the main housing 141. In this manner, the pin 204 locks to index a rotational position of the front housing 142 relative to the main housing 141 to limit or prevent over-rotation. If necessary, however, during disassembly, the spring plunger assembly 202 can be released by depressing the pin 204 (e.g., using a key, screwdriver, or the like to depress the pin 204 from the recess 210).

As such, in use, the spring plunger assembly 202 prevents over-tightening (e.g., provides positive tactile feedback and locking) of when the front housing 142 is properly positioned relative to the main housing 141. In addition, the spring plunger assembly 202 prevents accidental or unintentional loosening of the front housing 142 relative to the main housing 141.

It should be appreciated that while the present disclosure is being described and illustrated in connection with coupling the front housing 142 of the pin and sleeve device 100 to the main housing 141, it is envisioned that the spring plunger assembly 202 can be used in connection with any rotatable, mating components.

Figure 10:
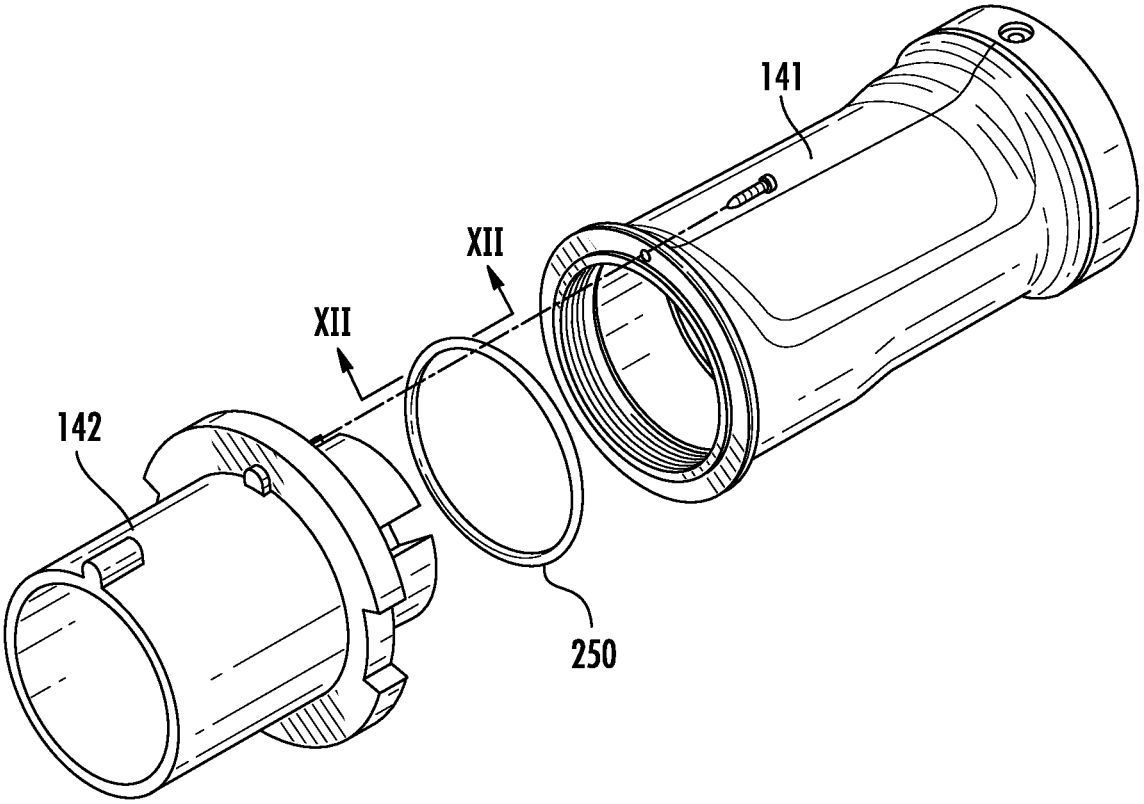
FIG. 10 is an exploded, partial perspective view of a pin and sleeve device incorporating a hollow O-ring in accordance with one aspect of the present disclosure.
Figure 11:
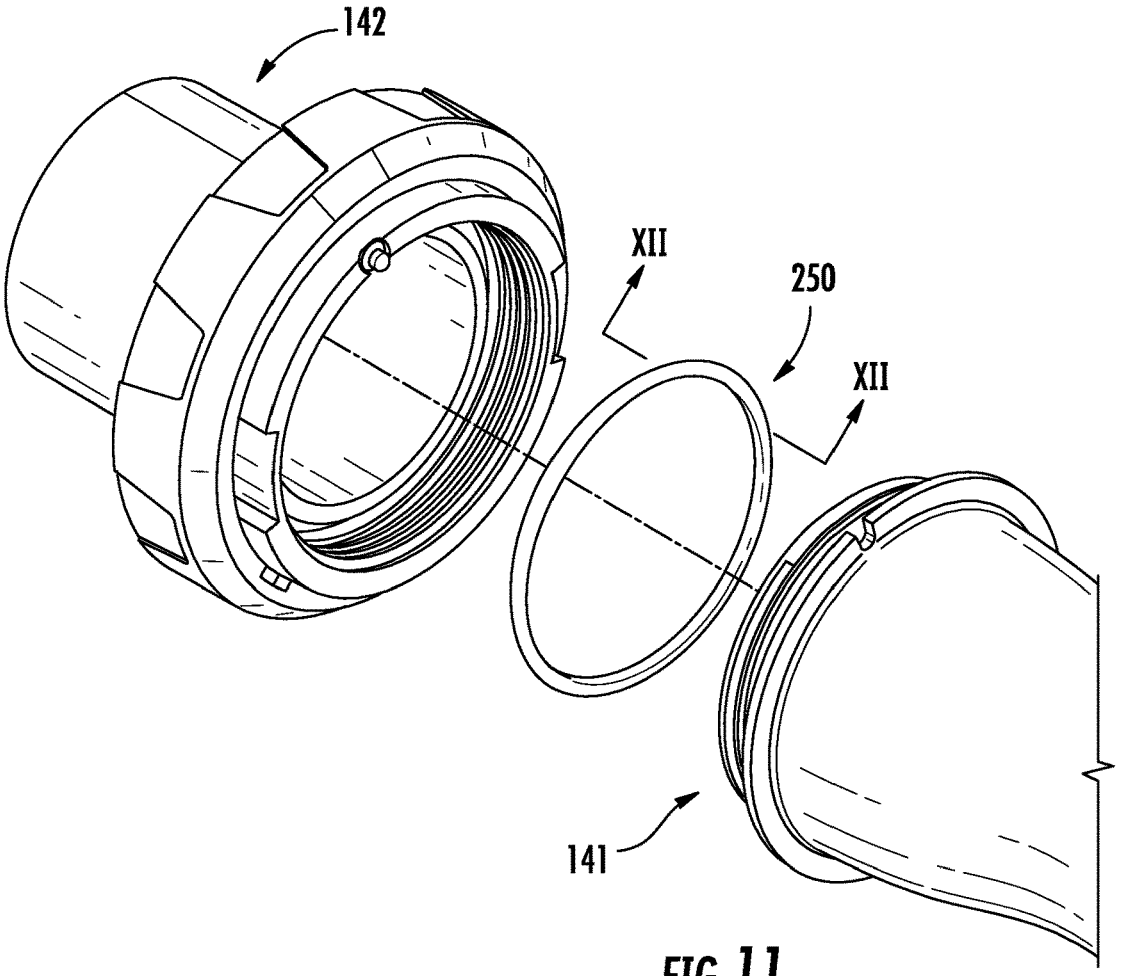
FIG. 11 is an exploded, partial perspective view of a pin and sleeve device incorporating a hollow O-ring in accordance with one aspect of the present disclosure.

Referring to FIGS. 10 and 11, and as will be appreciated by one of ordinary skill in the art, incorporation of seals such as, for example, O-rings between interconnected parts in devices is well known. For example, it is known to use O-rings to seal imperfect mating surfaces in cylindrical parts or between imperfect surfaces (e.g., molded plastic parts). As illustrated in FIG. 10, in one example embodiment, an O-ring 250 may be positioned between the main housing 141 and the front housing 142 of the pin and sleeve device 100 (e.g., connector 120). Alternatively, as illustrated in FIG. 11, in one example embodiment, an O-ring 250 may be positioned between the main housing 141 and the front housing 142 of the pin and sleeve device 100 (e.g., plug 130). In use, as will be appreciated by one of ordinary skill in the art, an O-ring 250 may be used between any two parts.

Figure 12:
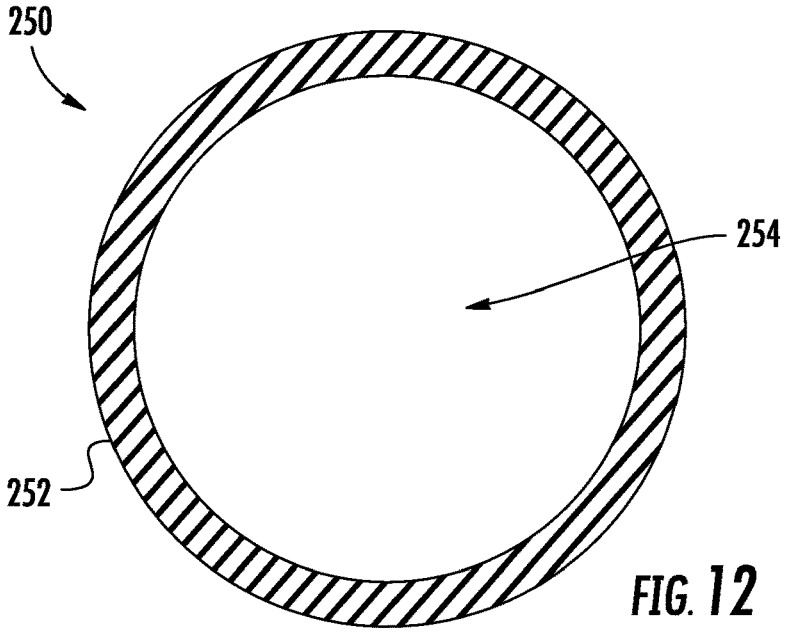
FIG. 12 is a cross sectional view of the hollow O-ring shown in FIGS. 9 and 10 taken through line XII-XII in FIGS. 10 and 11.

Referring to FIG. 12, in accordance with one non-limiting aspect of the present disclosure, the O-ring 250 is a hollow O-ring. As illustrated, the hollow O-ring 250 includes an outer surface 252 defining an internal cavity 254. Providing a hollow O-ring allows for improved sealing between imperfect surfaces without requiring heavy preloads or interference. In addition, utilization of hollow O-rings allows mating parts to maintain seal when surfaces are deflected or distorted due to heavy applied loads.

In contrast to standard O-rings that rely on heavy compression to affect a seal, hollow O-rings require much less force to compress and effect a seal. In addition, utilization of hollow O-rings also reduces stress and distortion on the mating components when assembled, ensuring proper and effective sealing with low torque applications in extreme environmental (wet, cold, icy) conditions.

While the present disclosure refers to certain embodiments, numerous modifications, alterations, and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof. The discussion of any embodiment is meant only to be explanatory and is not intended to suggest that the scope of the disclosure, including the claims, is limited to these embodiments. In other words, while illustrative embodiments of the disclosure have been described in detail herein, it is to be understood that the inventive concepts may be otherwise variously embodied and employed, and that the appended claims are intended to be construed to include such variations, except as limited by the prior art.

The foregoing discussion has been presented for purposes of illustration and description and is not intended to limit the disclosure to the form or forms disclosed herein. For example, various features of the disclosure are grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The phrases "at least one", "one or more", and "and/or", as used herein, are open-ended expressions that are both conjunctive and disjunctive in operation. The terms "a" (or "an"), "one or more" and "at least one" can be used interchangeably herein. All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., engaged, attached, coupled, connected, and joined) are to be construed broadly and may include intermediate members between a collection of elements and relative to movement between elements unless otherwise indicated. As such, connection references do not necessarily infer that two elements are directly connected and in fixed relation to each other. All rotational references describe relative movement between the various elements. Identification references (e.g., primary, secondary, first, second, third, fourth, etc.) are not intended to connote importance or priority but are used to distinguish one feature from another. The drawings are for purposes of illustration only and the dimensions, positions, order and relative to sizes reflected in the drawings attached hereto may vary.

What is claimed is:

1. An electrical pin and sleeve device comprising:

an outer housing including a first housing portion and a second housing portion;

a contact carrier at least partially positioned within the outer housing, the contact carrier including a plurality of holes;

a body member at least partially positioned within the outer housing and coupled to the contact carrier; and a plurality of electrical contacts, each of the plurality of contacts being positioned at least partially within a respective one of the plurality of holes in the contact carrier;

wherein the first and the second housing portions each include a coupling end having an interrupted thread formed thereon, each interrupted thread including a threaded segment and a threadless section; and wherein one of the first and second housing portions include a spring-loaded pin extending from a first surface thereof and the other one of the first and second housing portions includes a recess arranged and configured to receive a portion of the spring plunger assembly to secure a position of the second housing portion relative to the first housing portion.

2. The pin and sleeve device of claim 1, wherein:

the interrupted thread formed on the coupling end of the first housing portion includes a plurality of threaded segments circumferentially spaced about a circumference thereof, the plurality of threaded segments being circumferentially spaced apart by the threadless sections formed on the coupling end of the first housing portion;

the interrupted thread formed on the coupling end of the second housing portion includes a plurality of threaded segments circumferentially spaced about a circumference thereof, the plurality of threaded segments being circumferentially spaced apart by the threadless sections formed on the coupling end of the second housing portion;

the threaded segments formed on the coupling end of the first housing portion being arranged and configured to be axially received within the threadless sections formed on the coupling end of the second housing portion;

the threaded segments formed on the coupling end of the second housing portion being arranged and configured to be axially received within the threadless sections formed on coupling end of the first housing portion; and the second housing portion being coupled to the first housing portion via partial rotation of the second housing portion relative to the first housing portion after axially inserting the coupling end of the second housing portion and the coupling end of the first housing portion, one within the other.

3. The pin and sleeve device 1, wherein the interrupted thread formed on the coupling end of the first housing portion and the coupling end of the second housing portion each include four threaded segments and four threadless sections circumferentially spaced thereabout.

4. The pin and sleeve device of claim 1, wherein the pin is releasable to selectively release the second housing portion relative to the first housing portion.

5. The pin and sleeve device of claim 1, further comprising a hollow O-ring, the hollow O-ring being positioned between the first and second housing portions.

6. An electrical pin and sleeve device comprising:

an outer housing including a first housing portion and a second housing portion;

a contact carrier at least partially positioned within the outer housing, the contact carrier including a plurality of holes;

a body member at least partially positioned within the outer housing and coupled to the contact carrier; and a plurality of electrical contacts, each of the plurality of contacts being positioned within a respective one of the plurality of holes in the contact carrier;

wherein one of the first and the second housing portions include a spring-loaded pin extending from a first surface thereof and the other one of the first and second housing portions includes a recess arranged and configured to receive a portion of the spring-loaded pin to secure a position of the second housing portion relative to the first housing portion; and wherein the spring-loaded pin is releasable to release the second housing portion relative to the first housing portion.

7. The pin and sleeve device of claim 6, wherein the first and second housing portions each include an interrupted thread including a threaded segment and a threadless section.

8. The pin and sleeve device of claim 7, wherein:

the interrupted thread formed on the first housing portion includes a plurality of threaded segments circumferentially spaced apart about a circumference thereof, the plurality of threaded segments being circumferentially spaced apart by the threadless sections formed on the first housing portion;

the interrupted thread formed on the second housing portion includes a plurality of threaded segments circumferentially spaced apart about a circumference thereof, the plurality of threaded segments being circumferentially spaced apart by the threadless sections formed on the second housing portion;

the threaded segments formed on the first housing portion being arranged and configured to be axially received within the threadless sections formed on the second housing portion;

the threaded segments formed on the second housing portion being arranged and configured to be axially received within the threadless sections formed on the first housing portion; and the second housing portion being coupled to the first housing portion via partial rotation of the second housing portion relative to the first housing portion after axially inserting the coupling end of the second housing portion and the coupling end of the first housing portion, one within the other.

9. The pin and sleeve device 17, wherein the interrupted thread formed on the first housing portion and the second housing portion each include four threaded segments and four threadless sections circumferentially spaced thereabout.

10. The pin and sleeve device of claim 6, further comprising a hollow O-ring, the hollow O-ring being positioned between the first and second housing portions.

11. An electrical pin and sleeve device comprising:

an outer housing including a first housing portion and a second housing portion;

a contact carrier at least partially positioned within the outer housing, the contact carrier including a plurality of holes;

a body member at least partially positioned within the outer housing and coupled to the contact carrier; and a plurality of electrical contacts, each of the plurality of contacts being positioned at least partially within a respective one of the plurality of holes in the contact carrier;

wherein the first and the second housing portions each include a coupling end having an interrupted thread formed thereon, each interrupted thread including a threaded segment and a threadless section; and wherein one of the first and the second housing portions include a spring-loaded pin extending from a first surface thereof and the other one of the first and second housing portions includes a recess arranged and configured to receive a portion of the spring-loaded pin to secure a position of the second housing portion relative to the first housing portion.

* * * * *